US006810705B1

(12) United States Patent
Leppin et al.

(10) Patent No.: US 6,810,705 B1
(45) Date of Patent: Nov. 2, 2004

(54) METHOD FOR FORMING AN INITIAL PROFILE OR A TOOL OF THE KIND AND A PROFILE THEREFOR

(75) Inventors: Christian Leppin, Schaffhausen (CH); Markus Gehrig, Schaffhausen (CH)

(73) Assignee: Alcan Technology & Management AG (CH)

( * ) Notice: Subject to any disclaimer, the term of this patent is extended or adjusted under 35 U.S.C. 154(b) by 0 days.

(21) Appl. No.: 10/130,730

(22) PCT Filed: Nov. 8, 2000

(86) PCT No.: PCT/CH00/00594

§ 371 (c)(1),
(2), (4) Date: May 20, 2002

(87) PCT Pub. No.: WO01/36121

PCT Pub. Date: May 25, 2001

(30) Foreign Application Priority Data

Nov. 18, 1999 (DE) ..... 199 55 694

(51) Int. Cl.[7] ..... B21D 7/00
(52) U.S. Cl. ..... 72/61; 72/369
(58) Field of Search ..... 72/61, 54, 58, 72/60, 369, 370.22

(56) References Cited

U.S. PATENT DOCUMENTS

| | | | | | |
|---|---|---|---|---|---|
| 3,348,402 | A | * | 10/1967 | Reistad | 72/217 |
| 4,777,006 | A | * | 10/1988 | Wenger et al. | 264/526 |
| 5,471,857 | A | | 12/1995 | Dickerson | |
| 5,718,048 | A | * | 2/1998 | Horton et al. | 29/897.2 |
| 5,809,818 | A | * | 9/1998 | Usui | 72/54 |
| 6,122,948 | A | | 9/2000 | Moses | |

FOREIGN PATENT DOCUMENTS

| | | | | |
|---|---|---|---|---|
| DE | 35 32 499 | | 11/1986 | |
| DE | 43 20 237 | | 8/1994 | |
| DE | 195 07 611 | | 9/1995 | |
| DE | 198 10 196 | | 9/1999 | |
| DE | 198 33 006 | | 2/2000 | |
| EP | 588 528 | | 3/1994 | |
| EP | 770 435 | | 5/1997 | |
| JP | 57019114 A | * | 2/1982 | B21D/26/02 |
| JP | 07214147 A | * | 8/1995 | B21C/37/15 |
| JP | 08168814 A | * | 7/1996 | B21C/23/14 |
| WO | WO 89/07495 | | 8/1989 | |
| WO | WO8907495 | * | 8/1989 | |
| WO | WO 00/48762 | | 8/2000 | |
| WO | WO0048762 | * | 8/2000 | |

* cited by examiner

*Primary Examiner*—Lowell A. Larson
(74) *Attorney, Agent, or Firm*—Ostrolenk, Faber, Gerb & Soffen, LLP

(57) ABSTRACT

A process for forming a starting profile with a profile cavity by a bending forming process and an internal high pressure produced in a sealed profiled cavity by way of a fluid, including the steps of initially, before forming by internal high pressure, forming a starting profile at a distance from free ends of the starting profile and across a longitudinal axis of the starting profile into a cross-section with favorable bending properties, by one of transversely inwardly bent side walls of the starting profile, folding during bending, flat pressing or a flat high-sided profile produced in an extrusion process.

9 Claims, 4 Drawing Sheets

Figure 1:
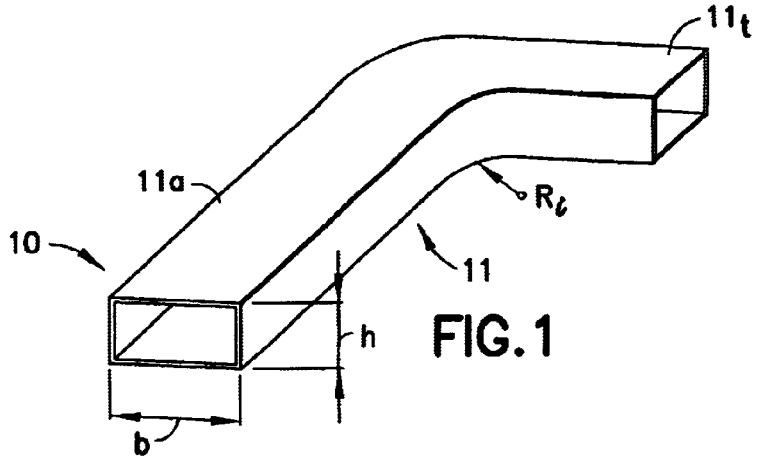

METHOD FOR FORMING AN INITIAL PROFILE OR A TOOL OF THE KIND AND A PROFILE THEREFOR

PRIORITY CLAIM

This is a U.S. national stage of application No. PCT/CH00/00594, File on Nov. 8, 2000. Priority is claimed on that application and on the following application:

Country: Germany, Application No.: 19955694.6, Filed: Nov. 18, 1999.

BACKGROUND OF THE INVENTION

This invention relates to a process for forming a starting profile or a similar workpiece into an end profile by means of an internal high pressure produced in the sealed profile cavity by way of a fluid active means, in particular for forming until the end profile rests against the wall of a form chamber. In addition, the invention comprises a profile with a profile area separated by at least one profile wall as a starting profile for the performance of the process.

In so-called internal high pressure forming (IHPF process) a hollow profile is elongated by means of internal pressure. In addition, the hollow profile can be pushed by means of at least one pusher on the workpiece and stretched, compressed, or expanded.

DE 35 32 499 C1 discloses for example a device to hydraulically expand a pipe section by using a peg-like cylindrical probe inserted in the pipe, which by means of at least two spaced ring seals creates a seal area with the pipe section to be expanded, which is filled with pressure medium in order to expand the pipe. Before the start of the expanding process, the two ring seals are filled with pressure medium to seal the ring gap between the probe and the pipe. The pressure medium is supplied to the ring area by way of at least one reception slot and is controlled by a ring seal which serves as a valve and which closes the opening found between the reception slot and the ring area until it has achieved its seal effect by way of elastic expansion.

This internal high pressure forming or hydro-forming is increasingly used as an economic manufacturing procedure for bodywork components in car construction. Tubular steel is predominately used as the starting material. Recently, for IHPF processes, aluminium material has also been added to the steel. In the same way as steel, this gives manufacturing procedures in which tubes of sheet aluminium are used as starting material; however, aluminium extrusion profiles may also be used as an alternative. This is out of the question in the case of steel for economic reasons. The use of extrusion profiles has the decisive advantage that there are almost no limits to the shaping of the starting profile.

For forming metallic tubes or extrusion profiles by means of bending, an attempt is generally made to organise the bending process in such a way that the starting cross-section of the workpiece remains contained in the then curved workpiece. Folds on the internal radius and on the outer radius should be avoided. Various techniques have been developed in order to achieve this aim; as an example a few such procedures are listed:

stretch bending;

bending over a mandrel;

hot bending.

Such bending techniques are also applied in the case of curved hydro-forming components, the manufacture of which involves a bending process before internal high pressure forming.

In view of these facts, the object of the present invention is to find an alternative bending procedure for hydro-forming components, thereby deliberately avoiding in the bending forming process the aim of giving or maintaining a shape which most closely resembles the contours of the final cross-section to be formed.

The doctrine of the independent claim leads to solution of this task; the sub-claims indicate favourable further embodiments. In addition the invention includes all combinations of at least two of the characteristics contained in the description, the depiction and/or the claims.

In accordance with this invention, before forming through internal high pressure, the starting profile at a distance from its free ends and across its longitudinal axis is formed into a cross-section with favourable bending properties, notably into a flat or roughly oval cross-section. It has also proved favourable to assign to a tool the starting profile with the area to be distorted, which for example is extruded from a light metal alloy or bent and constructed from a sheet metal, and to distort the cross-section by means of this tool; in addition the starting profile should be bent after the distortion cross-sectionally around this area.

The invention also includes mounting the starting profile on a stationary tool and distorting and bending its cross-section by way of a translatory and rotationally movable counter-tool.

An advantageous starting profile for the procedures in accordance with this invention is an approximately H-shaped cross-section with two roughly parallel chambers connected to each other. Their supporting walls should be cross-sectionally bent inwards, whereas the inner boundaries of the chambers are formed by groove-like recesses.

In this case a combined bending IHPF process is used for which no limits are set regarding the choice of starting material in principle; the latter can for example be aluminium, steel or any other metal, if necessary even a non-metallic material. The following bending procedure methods can be distinguished for use in combination with the IHPF process:

a preceding deformation into a cross-section with favourable bending properties;

an accompanying forming into a bendable cross-section during the bending process;

a shaping of bendable cross-sections in extrusion profiles, preferably from an aluminium alloy, without the preceding or accompanying forming process.

The inventor forces targeted folds during bending or he compresses the material flat; if necessary he shapes extrusion profiles in the starting condition correspondingly as flat upright profiles in order thus to achieve a small moment of surface inertia so that corresponding slight plastic distortions are produced in the bending forming process. Only in the ensuing IHPF process will the workpiece be shaped to its final form.

In the combination of bending and IHPF process in accordance with this invention there is a distinct separation of tasks:

the bending process is used to shape the component centre line, the IHPF process is used to form the cross-section.

In this procedure above all a minimisation of the degree of forming is achieved rather than a simplification of technical complexity with regard to bending. In the bending process in accordance with this invention, the achieved degree of forming is diminished substantially compared to a bending process after a procedure taken from the state of the art. With a classic bending technology in which the aim of the bending process is to achieve a cross-sectional contour as close as possible to the desired end result, only in exceptional cases are favourable results achieved in relation to the accumulated plastic distortions. In contrast, in the use of the bending strategy in accordance with this invention, due to the lower forming degree in the ensuing IHPF process, a higher residual forming capacity is available.

The bending procedure in accordance with this invention for the manufacture of IHPF components offers substantial advantages, including:

Greater shaping can be achieved in the IHPF process with the same material, i.e. there is more freedom in the shape of the end contour of a IHPF component; and IHPF components with far smaller radii of curvature are possible with the same cross-sectional dimensions.

Figure 2:
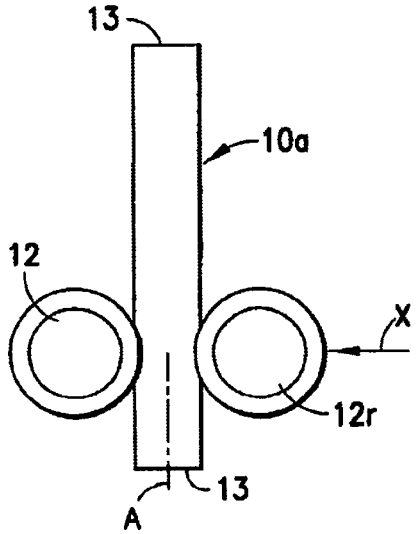
Figure 3:
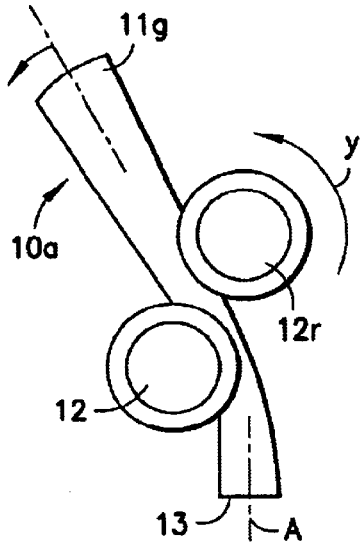
Figure 4:
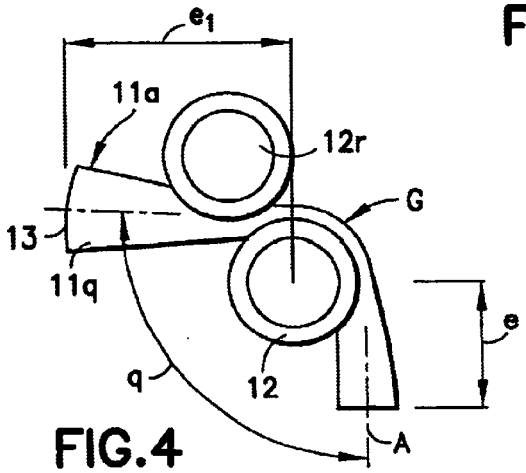
Figure 5:
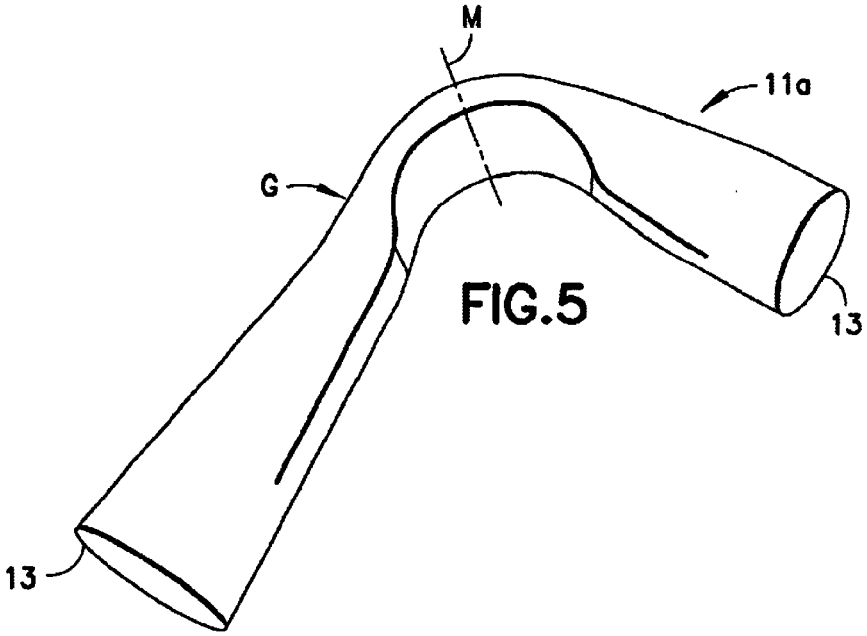
Figure 6:
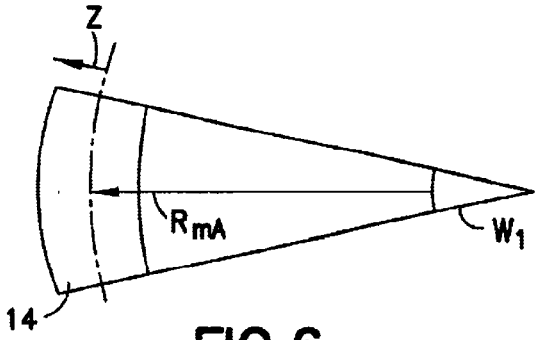
Figure 8:
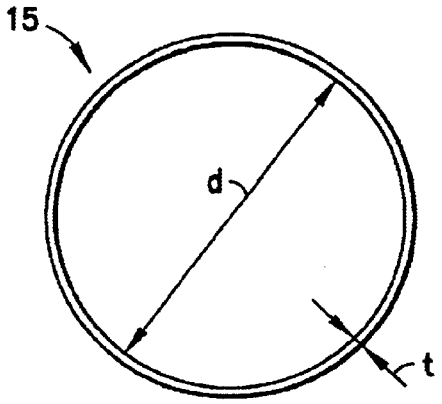
Figure 10:
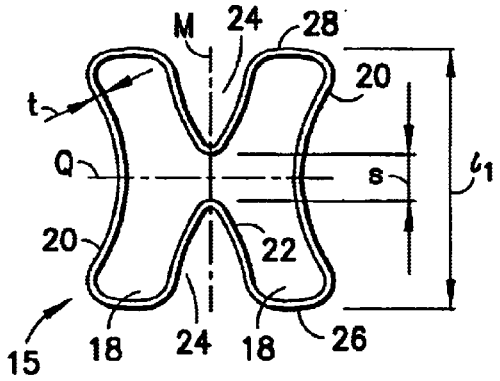
Figure 11:
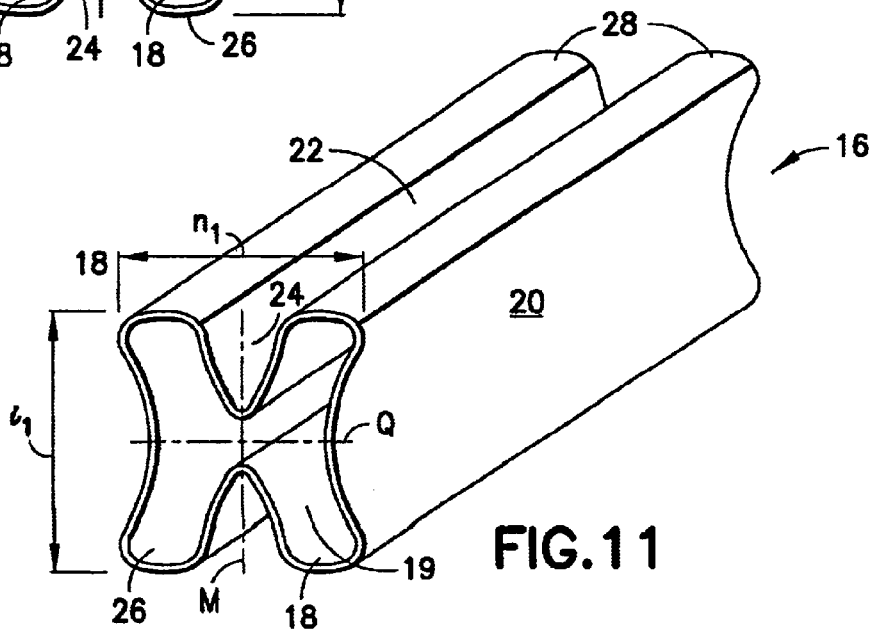
Figure 12:
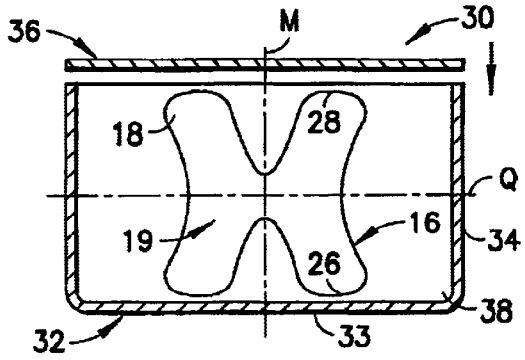
Figure 14:
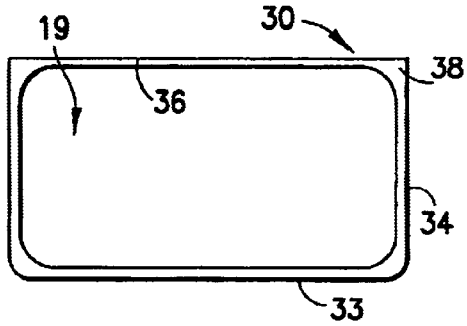

Additional advantages, features and details of the invention can be found in the following description of the preferred embodiment examples and from the drawing; this shows in:

FIG. 1: an oblique view of a curved square profile;

FIGS. 2, 3, 4: three sketches of the steps of a bending procedure;

FIG. 5: an enlarged oblique view of the product of the bending procedure;

FIG. 6, 7: sketches pertaining to a calculating procedure;

FIG. 8, 9, 10: each a cross-section through an initial profile for the manufacture of the square profile;

FIG. 11: an oblique view of an initial profile with the cross-section in FIG. 10; and FIGS. 12 to 15: four sketches pertaining to the course of the shaping of he square profile.

DETAILED DESCRIPTION OF THE PREFERRED EMBODIMENT

From the square pipe 10 with a width b of 80 mm and a cross-sectional height h of 50 mm, during a bending procedure with an ensuing IHPF process an angle peice 11 is manufactured containing pipe sections $\mathbf{11}_q$, $\mathbf{11}_t$ running at right angles to each other with an internal curvature radius $R_i$ of 200 mm.

FIGS. 2 to 5 show the bending of a pipe profile $10_a$ of round cross-section to an angle piece $11_a$ with a curvature angle q of 90°; in the course of this procedure each pipe profile $\mathbf{10}_a$ is positioned between two roll-like tools 12, $\mathbf{12}_r$ in such a way that here it lies tangentially on one of the tools 12 of this tool pair approximately outside its linear centre, after which the other tool $\mathbf{12}_r$ is moved in translation in direction x up to the pipe profile $\mathbf{10}_a$ as a counter-tool. The movable tool $\mathbf{12}_r$ then makes its way around the stationary tool 12 in a rotational direction y and thereby takes with it the upper pipe section $\mathbf{11}_q$ in FIGS. 2 to 4 with the pipe profile $\mathbf{10}_a$ from the longitudinal axis A.

The view in FIG. 5 shows that said pipe profile $\mathbf{10}_a$ has been indented on the stationary tool 12 in the support area during the bending procedure. This distorted area G determines intervals e, $e_1$ with the end contours 13 of the pipe profile $\mathbf{10}_a$ and the angle pieces $\mathbf{11}_a$. Its vertical centre line is indicated by M.

Figure 7:
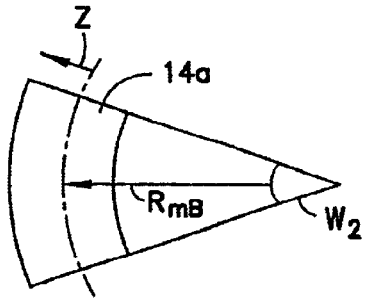

The following theoretical considerations form the basis of the manufacturing procedure, with reference to FIGS. 6, 7. A profile section 14 has in its starting condition according to FIG. 6 the local curvature radius $R_{mA}$ and is bent into its end condition $\mathbf{14}_a$ according to FIG. 3 in such a way that the curvature radius $R_{mB}$ arises in this end condition; the two curvature radii $R_{mA}$ and $R_{mB}$ each refer to the bend-neutral fibres of the cross-section. On the assumption that no alteration to the cross-section occurs during bending, for extension z at any point at a distance z from any neutral fibre w have:

$$\varepsilon_z = \frac{l_{zB} - l_{zA}}{l_{zA}} = \frac{W_2(R_{mB} + Z) - W_1(R_{mA} + Z)}{W_1(R_{mA} + Z)}$$

where $l_{zA}$, $l_{zB}$ are the lengths before and after the bending process, $W_1$ the angle enclosed by the pipe and profile section 14 before bending and $W_2$ the angle enclose by the profile section $14_a$ after bending.

The length of the neutral fibre remains constant on bending without super-imposed stretching:

$$W_2 R_{MB} = W_1 R_{mA}$$

After the implementation and forming process the result is $$\varepsilon_z = \frac{Z(R_{mA} - R_{mB})}{R_{mA}(R_{mA} + Z)} \quad \text{or} \quad \varepsilon_z = \frac{Z(1 - R_{mB}/R_{mA})}{R_{mB}(1 + Z/R_{mA})}$$

for elongation at any point at a distance z from the neutral fibre. For the exception of a non-curved starting material ($R_{ma}=\infty$) the result is $$\varepsilon_z = \frac{Z}{R_{mB}}$$

Extreme values of elongation $\epsilon_z$ are produced for extreme distances z to the neutral fibre. In the event of symmetrical cross-sections with a width b, $z_{max}$=b/2 and therefore $$\varepsilon_z = \frac{b(R_{mA} - R_{mB})}{R_{mB}(2R_{mA} + b)} \quad \text{or} \quad \varepsilon_z = \frac{b(1 - R_{mB}/R_{mA})}{R_{mB}(2 + b/R_{mA})}$$

Under the given conditions, with equations (1) to (3) the elongations occurring in a pipe or profile 14, including the maximum elongation during a bending formation can be estimated.

For example, in FIG. 8, a cross-sectionally cylindrical pipe profile 15 with a diameter d of 80 mm and a wall thickness t of 2 mm should be bent before an IHPF process in such a way that an inner curvature radius $R_i$ of 200 mm is produced. In a conventional bending process, the maximum elongation at the outer radius can be estimated according to the said equation (3). With the given starting values $$B=d=80 \text{ mm};\ R_{mA}=\infty;\ R_{mB}=d/2+200 \text{ mm}=240 \text{ mm}$$

the following value is obtained $$\epsilon_{max}=16.7\%$$

In order to reduce the maximum elongation occurring in the bending process, the pipe cross-section is distorted before the bending process in such a way that an approximately elliptical cross-section is produced with a height i of 112 mm and a width n of 48 mm with the main axes indicated by M and Q. The cross-sectional periphery of the elliptical profile 15*a*, here 251.30 mm, remains the same as that of the circular pipe or pipe profile 15.

At the apex of the elliptical cross-section there is a curvature or apex radius r of 10 mm and as stated a total width n after the described distorted indentation of just 48 mm.

This indentation of the pipe profile 15 yields a maximum strain in the apex of the cross-section. Here too, the resulting maximum elongations can be estimated by means of the said equation (3);

$$b=t=2\text{ mm};\ R_{mA}=d/2=40\text{ mm};\ R_{mB}=r=10\text{ mm}$$

giving a maximum circumference elongation of $\epsilon_{max}$=7.3% as a result of that indentation of the pipe profile or pipe 15 at the apex point of the resulting profile $\mathbf{15}_a$ of elliptical cross-section.

Due to the reduced width of n=48 mm, the expansion on the outer radius in the longitudinal direction in the ensuing bending process only amounts to $\epsilon_{max}$=10.0%. With a bending process in which the pipe cross-section has been previously distorted by indentation, the maximum elongation can be reduced by almost half in relation to conventional bending techniques.

As the use of a circular cross-section in the bending process leads to a comparatively high degree of forming, it is better to choose an elliptical cross-section in this instance but this is unfavourable for the feeding of a IHPF tool 30 as indicated in FIGS. 12 to 15; namely this tool 30 cannot then be closed without crushing the previously bent workpiece or profile 14*a*.

On bending an optimal initial profile 16, resembling an "H" in cross-section in accordance with FIG. 10, the same forming degree is achieved as with the elliptical cross-section. In addition, however, the bent workpiece can be inserted into the IHPF tool 30 without any problems.

The posed or folded initial profile 16 with a height $i_1$ of 50 mm and a width $n_1$ of 48 mm is as stated of H-shaped cross-section with two approximately parallel vertical chambers 18, the outer supporting walls 20 of which are bent inwards to the horizontal main axis Q. The inner chamber walls 22 are sections of bead-like recesses 24 of the base wall 26 and the ridge wall 28 of the initial profile 16. The spacing s of the bottom of both recesses 24 corresponds roughly to one-sixth of the profile height $i_1$.

Figure 9:
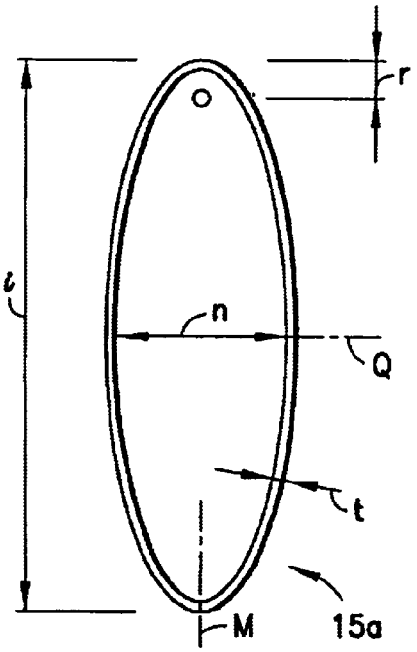

Both the width $n_1$ of this initial profile 16 in oblique view as detailed in FIG. 11 and its cross-sectional periphery correspond to the corresponding measurements of the elliptical profile $\mathbf{14}_a$ in FIG. 9.

The initial profile 16 produced during extrusion is placed in the tool 32 comprising a base tool or holder part 30 and the top tool or cover part 36. From these only those contours of the surface of the base tool 32 that are relevant for the forming process are sketched with base walls 33 and side walls 34 as well as the cover part 36.

Figure 13:
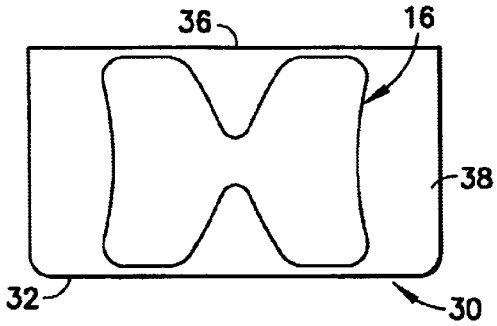
Figure 15:
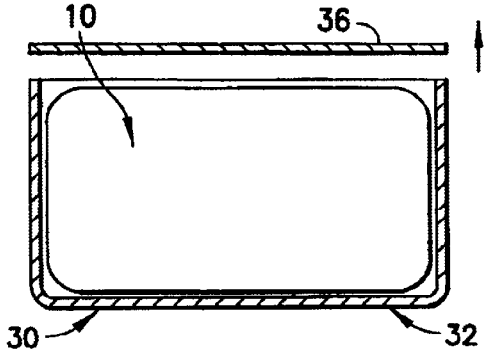

FIG. 13 shows steps to extend the initial profile 16 by way of a pressure medium introduced in its internal area 19. During this pressure process the base wall 33 and the side walls 34 of the base tool 32 and the cover tool 36 are positioned on the inside of the initial profile 16 lying in the tool area 38. The expansion of the base wall 26 and the ridge wall 28 is thus very slight; the initial profile 16 folds due to the pressure medium introduced into its internal area 19, almost to a concertina-like shape, and thus fills out the tool area 38. Only towards the end of the folding process are the walls 20, 26, 28 of the profile 16 expanded when the tool area 38 is distorted.

The square pipe 10 or angle piece 11 produced in tool 30 as described above is then taken out of the tool area 38 (FIG. 15).

What is claimed is:

1. A process for forming and deforming a starting profile of a component with a profile cavity into a curved end profile, comprising the following steps:

manufacturing a metallic starting profile with favorable bending properties in an extrusion process;

bending the starting profile into a curved shape; and forming a contour of the end profile by internal high pressure produced in a sealed profile cavity by way of a fluid active means, whereby during the bending step a center line of the component is molded and by applying the internal high pressure a cross-section of the component is distorted into its end shape.

2. A process according to claim 1, wherein the manufacturing step includes forming the starting profile to have a substantially H-shaped cross-section with at least two roughly parallel chambers which are connected to each other.

3. A process according to claim 2, wherein the starting profile is formed to have supporting walls which are bent inwards cross-sectionally.

4. A process according to claim 2, wherein the starting profile is formed so that the chamber has inner borders formed by groove-like recesses on base and ridge surface areas.

5. A process for forming and deforming a starting profile of a component with a profile cavity into a curved end profile, comprising following steps:

manufacturing a starting profile from a metal sheet with favorable bending properties by bending and joining the metal sheet;

bending the starting profile into a curved shape; and forming a contour of the end profile by internal high pressure produced in a sealed profile cavity by way of a fluid active means, whereby during the bending step a center line of the component is molded and by applying the internal high pressure a cross-section of the component is distorted into its end shape.

6. A process according to claim 5, wherein the manufacturing step includes forming the starting profile to have a substantially H-shaped cross-section with at least two roughly parallel chambers which are connected to each other.

7. A process according to claim 6, wherein the starting profile is formed to have supporting walls which are bent inwards cross-sectionally.

8. A process according to claim 6, wherein the starting profile is formed so that the chamber has inner borders formed by groove-like recesses on base and ridge surface areas.

9. A process for forming and deforming a starting profile of a component with a profile cavity into a curved end profile, comprising following steps:

manufacturing a starting profile;

mounting the starting profile on a roll-like stationary tool and distorting the starting profile cross-sectionally to get a cross-section with favorable bending properties while bending the starting profile by a translatory and rotationally moveable, roll-like counter-tool into a curved shape; and forming a contour of the end profile by internal high pressure produced in a sealed profile cavity by way of a fluid active means, whereby during bending a center line of the component is molded and by applying internal high pressure the cross-section is distorted into its end shape.

* * * * *